US010361042B2

(12) United States Patent
Comtois

(10) Patent No.: US 10,361,042 B2
(45) Date of Patent: Jul. 23, 2019

(54) REMOVABLE SWITCHING ELEMENT FOR AN ELECTRICAL SWITCHING DEVICE AND SWITCHING DEVICE FOR SWITCHING AN ELECTRIC CURRENT COMPRISING SUCH A REMOVABLE ELEMENT

(71) Applicant: Schneider Electric Industries SAS, Rueil-Malmaison (FR)

(72) Inventor: Patrick Comtois, Saint-Ismier (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/797,253

(22) Filed: Oct. 30, 2017

(65) Prior Publication Data

US 2018/0166227 A1 Jun. 14, 2018

(30) Foreign Application Priority Data

Dec. 8, 2016 (FR) ..... 16 62152

(51) Int. Cl.
*H01H 9/08* (2006.01)
*H01H 9/02* (2006.01)
(Continued)

(52) U.S. Cl.
CPC ..... *H01H 9/08* (2013.01); *H01H 1/14* (2013.01); *H01H 1/20* (2013.01); *H01H 1/58* (2013.01);
(Continued)

(58) Field of Classification Search
CPC ..... H01H 9/08; H01H 1/14; H01H 1/20
(Continued)

(56) References Cited

U.S. PATENT DOCUMENTS 3,596,218 A * 7/1971 Layton ..... H01H 71/04 200/308
3,973,094 A 8/1976 Kuhn
(Continued)

FOREIGN PATENT DOCUMENTS

DE 198 34 474 A1 2/2000
EP 0 774 768 A1 5/1997

OTHER PUBLICATIONS

French Preliminary Search Report dated Jul. 26, 2017 in French Application 16 62152 filed on Dec. 8, 2016 (with English Translation of Categories of cited documents).

*Primary Examiner* — Renee S Luebke
*Assistant Examiner* — Iman Malakooti
(74) *Attorney, Agent, or Firm* — Oblon, McClelland, Maier & Neustadt, L.L.P.

(57) ABSTRACT

A removable switching element for switching an electric current for an electrical switching device includes a housing; first and second fixed electrical conductors; a mobile electrical conductor that can be moved between a first position, in which the mobile electrical conductor electrically connects the first and second fixed electrical conductors; and a second position, in which the mobile electrical conductor is electrically isolated from the first and second fixed electrical conductors. The housing includes two windows passing therethrough, one being located facing an area of contact between the mobile conductor and the first fixed electrical conductor and the other being located facing an area of contact between the mobile conductor and the second fixed electrical conductor.

14 Claims, 4 Drawing Sheets

(51) Int. Cl.

| | |
|---|---|
| ***H01H 1/14*** | (2006.01) |
| ***H01H 1/58*** | (2006.01) |
| ***H01H 1/20*** | (2006.01) |
| ***H01H 3/00*** | (2006.01) |
| ***H01H 71/02*** | (2006.01) |
| ***H01H 71/50*** | (2006.01) |

(52) U.S. Cl.
CPC ..... *H01H 3/001* (2013.01); *H01H 9/02* (2013.01); *H01H 71/025* (2013.01); *H01H 71/501* (2013.01); *H01H 71/0214* (2013.01)

(58) Field of Classification Search
USPC ..... 200/239
See application file for complete search history.

(56) References Cited

U.S. PATENT DOCUMENTS

| | | | | |
|---|---|---|---|---|
| 5,652,420 | A | 7/1997 | Innes et al. | |
| 6,064,289 | A * | 5/2000 | Wieloch | H01H 50/20 335/10 |
| 2001/0011650 | A1 | 8/2001 | Pohl | |
| 2016/0012983 | A1* | 1/2016 | Wu | H01H 13/04 200/295 |

* cited by examiner

REMOVABLE SWITCHING ELEMENT FOR AN ELECTRICAL SWITCHING DEVICE AND SWITCHING DEVICE FOR SWITCHING AN ELECTRIC CURRENT COMPRISING SUCH A REMOVABLE ELEMENT

The invention relates to a removable switching element for an electrical switching device. The invention also relates to an electrical switching device for switching an electric current comprising a removable switching element.

FR 2 999 790 A1 describes an electrical switching device comprising removable switching elements that are intended to be inserted into corresponding compartments of the device.

Each removable element is connected between corresponding connection lands of the electrical device and is suitable for interrupting an electric current flowing between these lands. This interruption is achieved by moving a mobile electrical conductor with respect to fixed electrical conductors that are connected to the connection lands by exerting mechanical pressure on a mobile bridge that is rigidly connected to the mobile conductor, for example by means of an electromechanical actuator.

One advantage of such removable elements is that they are interchangeable and therefore easy to replace during maintenance operations or in the event of the electrical device malfunctioning.

These known removable elements are however not entirely satisfactory for certain applications, in particular those in which a risk of accidentally welding the mobile conductor to the fixed conductors is possible and in which the operation of the electrical device should be interrupted for as little time as possible. Such welding may occur as a result of a short circuit flowing through the removable element.

These known removable elements do not allow an operator to easily dissociate the mobile electrical conductors from the fixed electrical conductors. It is then necessary to replace the removable element in order for the electrical device to continue to operate, which is unsatisfactory as it is costly in terms of time and material.

It is these drawbacks that the invention more particularly intends to overcome by proposing a removable switching element that allows an operator to visually check the state of the electrical conductors as well as to be able to intervene in order to dissociate these conductors from one another in the event of accidental welding, in a simpler manner.

To this end, the invention relates to a removable switching element for switching an electric current for an electrical switching device, this element comprising:

- a housing;
- first and second fixed electrical conductors that are isolated from one another;
- a mobile electrical conductor that can be moved between:
  - a first position, in which the mobile electrical conductor makes electrical contact with the first and second fixed electrical conductors at first and second contact areas, respectively; and
  - a second position, in which the mobile electrical conductor is at a distance from and electrically isolated from the first and second fixed electrical conductors.

The housing comprises two windows passing therethrough, one being located facing the first area of contact between the mobile conductor and the first fixed electrical conductor and the other being located facing the second area of contact between the mobile conductor and the second fixed electrical conductor.

By virtue of the invention, the through-windows allow an operator to view the states of the contact areas directly without having to open the housing of the removable element. In addition, the through-window allows a tool, such as a tip of a screwdriver or a chisel, to be inserted for the purpose of mechanically dissociating the fixed and mobile conductors from one another in the event that they have been accidentally welded to one another. In this way, maintenance operations may easily be carried out directly by an operator without it being necessary to physically open the housing, allowing the removable element to be reused and immobilized to a lesser extent.

According to advantageous but non-mandatory aspects of the invention, such a removable element may incorporate one or more of the following features, either alone or in any technically permissible combination:

- each window is arranged so as to expose the corresponding contact area and at least a portion of the mobile electrical conductor, the corresponding fixed electrical conductor being masked by the lateral face;
- for each window, a first edge of the window is aligned with a ridge of the fixed electrical conductor, which ridge is arranged on the edge of the face of this fixed electrical conductor, which face is turned towards the mobile electrical conductor, the window extending from the first edge towards a second, opposite edge, in the direction of the mobile electrical conductor and in the direction of movement of the mobile electrical conductor;
- the housing includes two opposite lateral faces, one of the windows being positioned on one of the lateral faces, the other window being positioned on the other lateral face;
- the housing includes two half-shells that are assembled together, each half-shell including a lateral face provided with one of said through-windows, the half-shells being similar to one another and being arranged symmetrically with respect to one another with respect to a point of symmetry located in a central position of the electrical unit;
- the windows are oblong, for example rectangular or elliptical, in shape;
- the windows each have dimensions that are adapted to the profile of a corresponding contact pad borne by the mobile conductor.

According to another aspect, the invention relates to an electrical switching device for switching an electric current, comprising:

- a base including compartments that are delimited by separating walls;
- at least one removable switching element for switching an electric current, intended to be accommodated in one of the compartments of the base, such that connection terminals of the removable element are electrically connected to electrical connection lands of the device.

The at least one removable switching element is in accordance with the invention.

According to advantageous but non-mandatory aspects of the invention, such an electrical switching device may incorporate one or more of the following features, either alone or in any technically permissible combination:

- the separating walls are made of an electrically insulating material;
- the separating walls include ribs and the lateral faces of the removable switching elements are provided with protrusions, the shapes of which protrusions are complementary to those of the grooves, so as to guide the removable switching element when the latter is inserted into the compartment.

The invention will be better understood and other advantages thereof will become more clearly apparent in the light of the following description of one embodiment of a removable switching element provided solely by way of example and with reference to the appended drawings, in which:

FIG. 1 shows an electrical switching device 2 for switching an electric current, also referred to as a breaker unit. The electrical device 2 is intended to make it possible to selectively interrupt an electric current flowing through one or more electric current lines, for example a polyphase current.

By way of illustrative example, the electrical device 2 is connected to an electrical supply line supplying power to an electric motor.

The electrical device 2 includes in this instance a base 4 and one or more electrical switching elements 6. Each element 6 is suitable for interrupting an electric current independently of the other elements 6 of the device 2.

In this example, the electrical device 2 is suitable for interrupting a three-phase current including three electrical phases, and is therefore suitable for accommodating three elements 6, each associated with one of these electrical phases.

Figure 1:
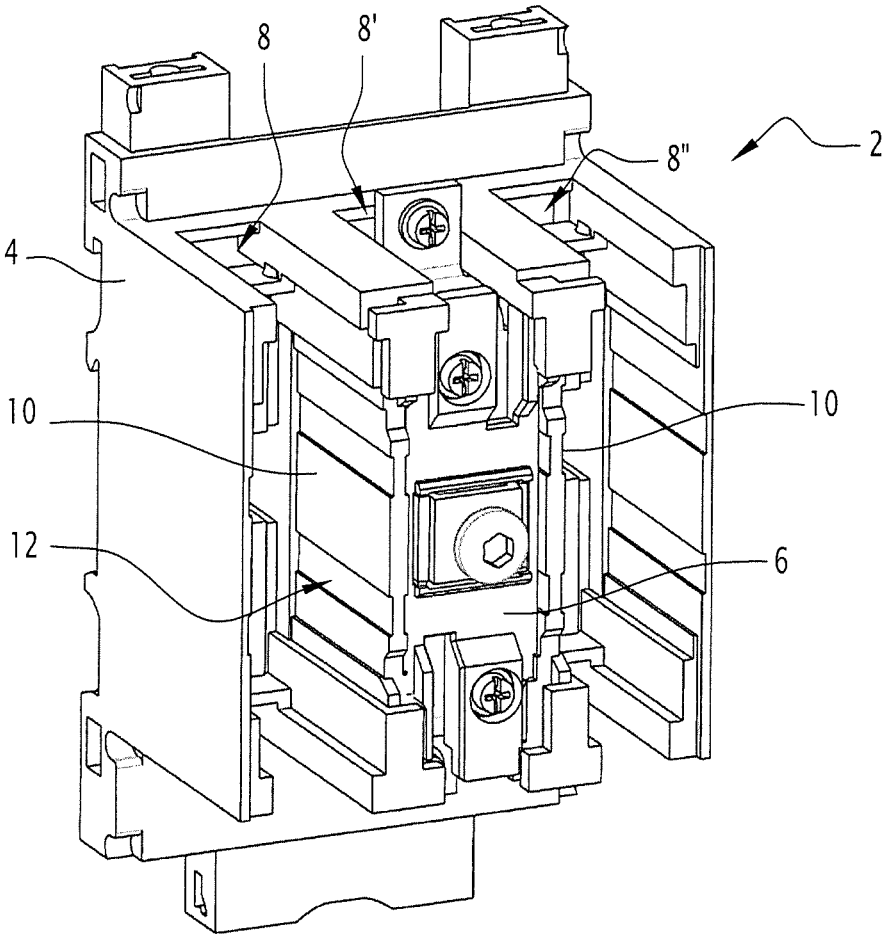
FIG. 1 is a schematic representation, in perspective, of an electrical switching device including a removable switching element in accordance with the invention.
Figure 2:
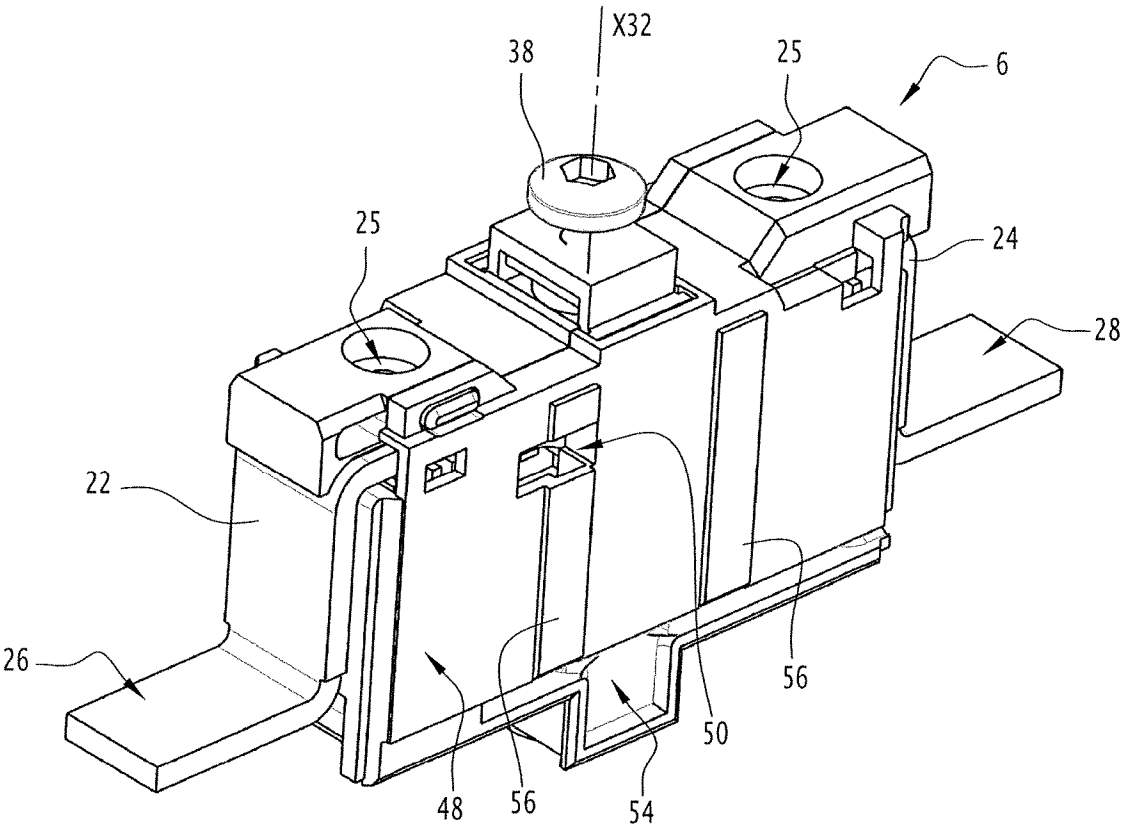
FIG. 2 is a schematic representation, in profile, of a removable switching element in accordance with the invention of FIG. 1.

In this example, the elements 6 are identical to one another. In order to simplify FIG. 1, only one example of the element 6 is illustrated.

The base 4 includes compartments 8, 8' and 8", numbering three in this instance and being identical to one another, each being suitable for accommodating a removable element 6. The compartments 8, 8' and 8" are in this instance complementary in shape to the elements 6.

The compartments 8, 8' and 8" are separated pairwise by separating walls 10. The walls 10 are made of an electrically insulating material, for example a plastic material, such as polyamide PA66.

The function of the separating walls 10 is to electrically insulate, pairwise, neighbouring elements 6 when they are accommodated within the compartments 8, 8' and 8", in order to prevent the occurrence of an electric arc between two adjacent elements 6 during operation thereof.

Advantageously, the separating walls 10 are provided with ribs 12, the role of which is explained in greater detail below.

As illustrated in FIGS. 2 to 5, the element 6 includes a housing 20, inside which fixed electrical conductors 22 and 24, extended by connection terminals 26 and 28, respectively, are housed. For example, the housing 20 is made of a plastic material, such as polyamide PA66.

The terminals 26 and 28 are intended to be electrically connected to corresponding connection lands of the device 2 when the element 6 is accommodated in a corresponding compartment 8, 8', 8".

The conductors 22 and 24 are in this instance rigidly fastened, with no degree of freedom, to a fixed portion of the element 6 by means of fastening elements 25 such as screws.

For example, the conductors 22 and 24 are bars made of a metallic material, such as copper. The fixed conductors 22 and 24 are in this instance identical to one another.

The fixed conductors 22, 24 are in this instance separated at a distance from one another and are thus electrically isolated from one another by the ambient air.

The element 6 additionally includes a mobile electrical conductor 30 that is movable, with respect to the fixed conductors 22 and 24, between distinct first and second positions.

For example, the conductor 30 is a bar made of a metallic material, such as copper.

The conductor 30 is in this instance rigidly mounted on a mobile contact holder 32. X32 denotes the geometric axis corresponding to the direction of movement of the mobile contact holder 32. Thus, the conductor 30 is translatably movable along the axis X32. A movement of the electrical conductor 30 therefore corresponds to a movement of the mobile contact holder 32.

In the first position, the conductor 30 electrically links the fixed conductors 22 and 24, thus allowing an electric current to pass from one fixed conductor to the other. The element 6 then allows the electric current to flow.

In the second position, the conductor 30 is at a distance from the fixed conductors 22 and 24, so as to prevent an electric current passing through the element 6.

In the first position, electrical contact between the fixed conductor 22 and the mobile conductor 30 is made at a first contact area. Analogously, electrical contact between the fixed conductor 24 and the mobile conductor 30 is made at a second contact area.

Each of the fixed conductors 22 and 24 includes an electrical contact pad 34 that is positioned at the corresponding contact area. Similarly, the mobile conductor 30 includes two contact pads 36, each being positioned at a corresponding contact area, facing the corresponding contact pad 34.

For example, the contact pads 34 and 36 are made of an electrically conductive material, such as copper or silver.

When the mobile conductor 30 is in its first position, the electrical contact between the fixed conductors 22, 24 and the mobile conductor 30 is made via the contact pads 34 and 36.

The mobile contact holder 32 includes an actuating apparatus 38 that is accessible from the outside of the housing 20 so as to selectively move the mobile contact holder 32 and the mobile conductor 30 between the first and second positions. For example, the apparatus 38 includes a screw, a head of which protrudes with respect to a front face of the element 6.

The element 6 additionally includes an elastic return member, which is for example mechanically connected to the mobile contact holder 32, and which is arranged to bring the conductor 30 into its first position by exerting a return force. The first position therefore corresponds to a rest position of the mobile conductor 30 and the second position corresponds to an excited position of the mobile conductor 30.

For example, the mobile contact holder 32 includes elastically deformable blades that are mechanically linked to the mobile conductor 30 and to the fixed portions of the element 6 in order to form the elastic return member. As a variant, the elastic return member may be produced differently, for example by means of a compression spring.

Thus, the mobile conductor 30 is moved from the first position to the second position by exerting a mechanical pressure on the apparatus 38 so as to push the mobile contact holder 32 towards the rear of the element 6.

For example, this movement is achieved using a controllable electromechanical actuator mounted on a front face of the device 2 when the element 6 is accommodated inside the corresponding compartment, this actuator being arranged to interact with the actuating apparatus 38.

As a variant, depending on the relative arrangement of the fixed conductors 22 and 24 with respect to the mobile conductor 30, the elastic return member associated with the mobile contact holder 32 may be configured differently, for example so that the rest position corresponds to the second position and the activated position corresponds to the first position.

Figure 3:
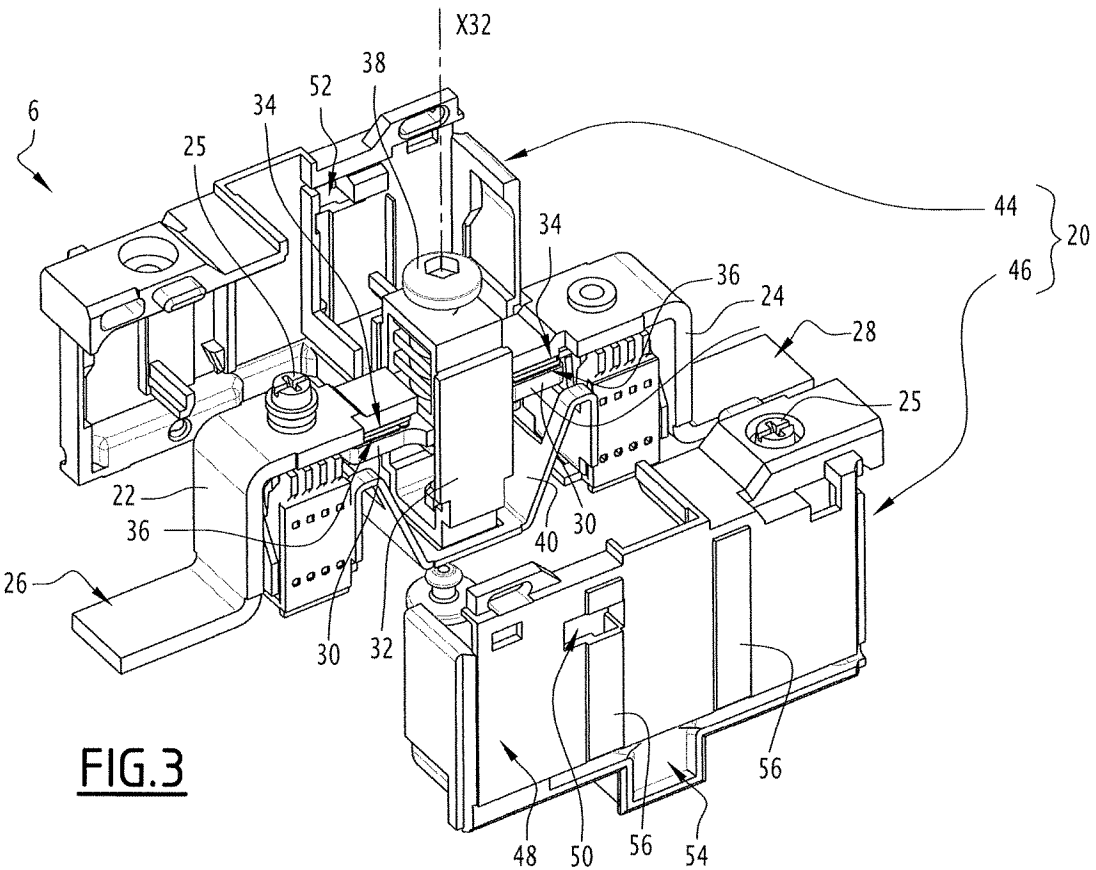
FIG. 3 is a schematic representation, in an exploded view, of the removable switching element of FIG. 2.

As illustrated in FIG. 3, the housing 20 includes in this instance two half-shells 44, 46 that are assembled together in order to form the housing 20. Each half-shell 44, 46 includes one lateral face 48 of the housing 20.

As a variant, the housing 20 may be produced differently. In any case, the housing 20 includes two opposite lateral faces 48.

The housing 20 includes two through-windows 50 and 52. The window 50 is located facing the contact area between the fixed conductor 22 and the mobile conductor 30. The window 52 is located facing the contact area between the fixed conductor 24 and the mobile conductor 30.

Thus, the windows 50 and 52 allow the state of the contact areas between the fixed conductors 22, 24 and the mobile conductor 30 to be viewed from outside the element 6, without having to physically open the housing 20 or to disassemble the element 6. Maintenance of the element 6 and hence of the device 2 is made easier.

The windows 50, 52 are made in one or more of the lateral faces 48.

In this example, the windows 50 and 52 are made in respective opposite lateral faces 48 of the housing 20. The window 50 is thus made in the lateral face 48 borne by the half-shell 46, while the window 52 is made in the lateral face 48 borne by the half-shell 44.

As a variant, the windows 50 and 52 may be made in one and the same lateral face 48 on one and the same side of the housing 20.

Preferably, the windows 50 and 52 are oblong, for example rectangular or elliptical, in shape. Advantageously, the dimensions of the windows 50, 52 are adapted to the profile of the contact pad 36 borne by the mobile conductor, as explained below.

The windows 50 and 52 are in this instance identical, such that only the window 50 is described in detail below.

Advantageously, the half-shells 46 and 48 are identical to one another and are arranged symmetrically with respect to one another, with respect to a point of symmetry located in a central position of the electrical unit 6. In this way, the number of different mechanical parts required to produce the element 6 is decreased, since the housing 20 is assembled using two identical half-shells 44 and 46.

As a variant, however, the half-shells 46 and 48 may be different.

Optionally, the housing 20 includes a degassing channel 54 that places the outside of the housing 20 in fluidic communication with the inside of the housing 20. The channel 54 is intended to allow the quenching gas to be removed from the element 6 in the event that an electric arc is formed during the separation of the fixed conductors 22, 24 from the mobile conductor 30.

In this example, the lateral faces 48 include protuberances, or protrusions 56, that are complementary in shape and in number to the ribs 12 formed in the separating walls 10 of the device 2.

The protrusions 56 and the ribs 12 allow the element 6 to be guided when the latter is moved with respect to the device 2, in particular for the insertion thereof into the corresponding compartment 8, 8', 8".

The window 50 is additionally sized so as to make it possible to dissociate, using a tool 60, the fixed electrical conductor 22 from the mobile contact 30 in the event of accidental welding at the first contact area. Such accidental welding is for example caused by partial melting of the contact pads 34, 36 as a result of a short circuit flowing therethrough.

Preferably, the shape of the window 50 is chosen so as to allow the insertion of a tip 62 of the tool 60. The tool 60 is for example a screwdriver or a chisel or any other analogous tool having an oblong-shaped rigid blade.

Figure 4:
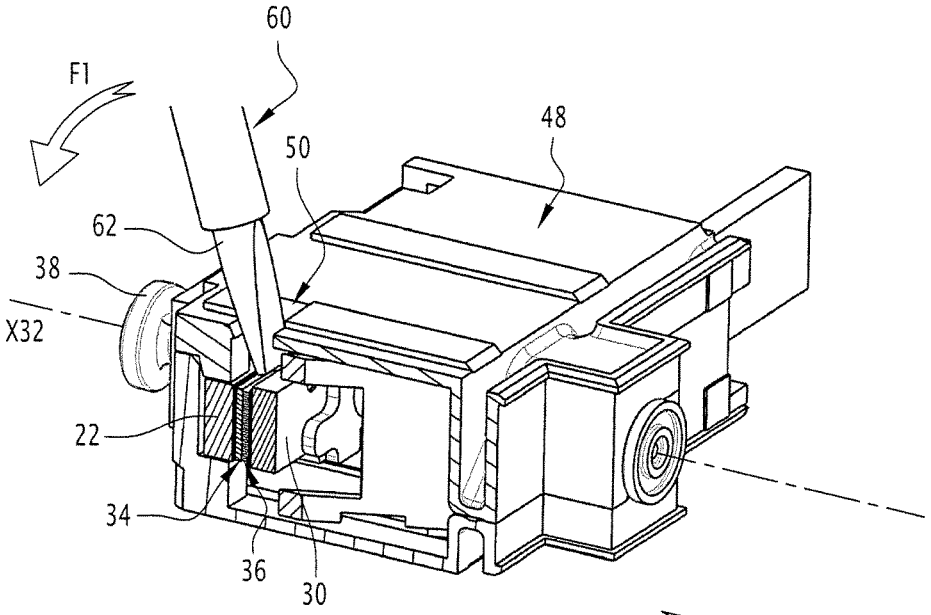
FIG. 4 is a schematic representation, in a partially cutaway view, of the removable switching element of FIG. 2 during an operation of dissociating the electrical conductors using a tool.

As illustrated in FIG. 4, such a dissociation is advantageously achieved by inserting the tip 62 through the window 50 and by exerting a mechanical shock on the mobile conductor 30, so as to separate it from the fixed conductor 22 by moving it in the direction of movement X32. A mechanical torque may also be applied by bearing the tip 62 on an edge of the window and by pivoting the tool 60, for example in the direction of the arrow F1, so as to move the mobile conductor 30 in a direction of movement illustrated by the arrow F2.

Preferably, the window 50 is arranged so as to expose the first contact area as well as a portion of the mobile electrical conductor 30. The fixed electrical contact 22 is masked by the lateral face 48, so as to limit its accessibility from outside the housing 20.

For example, a first edge of the window 50 is aligned with a ridge of the fixed conductor 22, which ridge is arranged on the edge of the face of the fixed conductor 22, which face is turned towards the mobile conductor 30. The window 50 extends from the first edge to a second, opposite edge of this window 50, extending in the direction of the mobile conductor 30 and in the direction of movement X32.

In this example, the first edge is an upper edge of the window 50 and the second edge is a lower edge of the window 50. The face of the fixed conductor 22, which face is turned towards the mobile conductor 30, is in this instance a lower face of the fixed conductor 22. The first edge of the window and said ridge of the fixed conductor 22 are positioned facing one another.

The dimensions of each window 50, 52 are adapted to the profile of the corresponding contact pad 36 borne by the mobile conductor. For example, for a rating of 100 A, the contact pad 36 has a profile of 10 mm in width by 2 mm in height. The size of the corresponding window is greater than or equal to these dimensions and allows the use of a tool having a tip 62, the size of the end of which is 5 mm in width by 1 mm in height for example. For example, the term "profile of the contact pad 36" refers to the dimensions of its lateral face facing the side of the corresponding window 50, 52.

Figure 5:
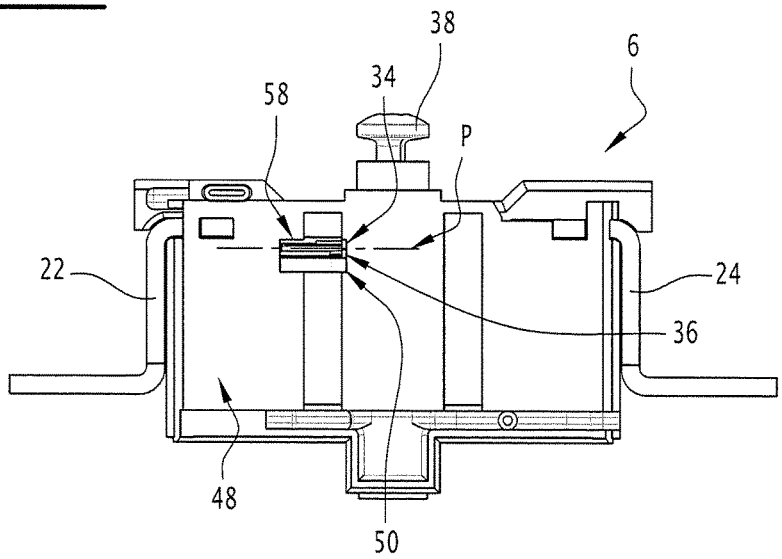
FIG. 5 is a schematic representation, in side view, of the removable switching element of FIG. 2 comprising a through-window in accordance with the invention.

By way of example, the lower face and said ridge of the conductor 22 belong in this instance to the geometric plane P such as illustrated in FIG. 5.

The function of this arrangement of the window 50 with respect to the fixed conductor 22 is to prevent the user from exerting a force on the conductor 22 with the tool 60 during an operation of dissociating the conductors 22 and 30. Since the window 50 extends from the lower edge of the fixed conductor 22 and in the direction of the mobile conductor 30, it prevents the user from positioning the tool 60 so as to bear on the fixed conductor 22 and, in parallel, allows the user to position the tool 60 so as to bear on the mobile conductor 30. This prevents the fixed conductor 22, which is not intended to be moved with respect to the fixed portion of the element 6, from being accidentally damaged.

The same applies for the window 52, facing the fixed electrical conductor 24 and the second contact area.

The embodiments and the variants contemplated above may be combined with one another so as to create new embodiments.

The invention claimed is:

1. A removable switching element configured to switch an electric current for an electrical switching device, the removable switching element comprising:

a housing;

first and second fixed electrical conductors that are isolated from one another; and a mobile electrical conductor movable between:

a first position, in which the mobile electrical conductor makes electrical contact with the first and second fixed electrical conductors at first and second contact areas, respectively, and a second position, in which the mobile electrical conductor is disposed at a distance from, and electrically isolated from, the first and second fixed electrical conductors, wherein the housing comprises two windows passing therethrough, one of the windows being disposed facing the first contact area between the mobile electrical conductor and the first fixed electrical conductor, and the other one of the windows being disposed facing the second contact area between the mobile electrical conductor and the second fixed electrical conductor, and wherein each window of the two windows is arranged so as to expose a corresponding contact area and at least a portion of the mobile electrical conductor, a corresponding fixed electrical conductor being masked by a corresponding lateral face of the housing.

2. The removable switching element according to claim 1, wherein, for each window of the two windows, a first edge of said each window is aligned with a respective corresponding ridge of the first or the second fixed electrical conductor, said ridge is arranged on an edge of a respective corresponding face of the first or the second fixed electrical conductor, said face being turned towards the mobile electrical conductor, said each window respectively extending from the first edge towards a second, opposite edge, in a direction of the mobile electrical conductor and in a direction of movement of the mobile electrical conductor.

3. The removable switching element according to claim 1, wherein the housing includes two opposite lateral faces, said one of the windows being positioned on one of the lateral faces, said other one of the windows being positioned on the other one of the lateral faces.

4. The removable switching element according to claim 3, wherein the housing further includes two similar half-shells that are assembled together, each half-shell including one of the two opposite lateral faces provided with one of said windows, and wherein the similar half-shells are arranged symmetrically with respect to one another and with respect to a point of symmetry located in a central position of the electrical switching device.

5. The removable switching element according to claim 1, wherein the two windows are each oblong in shape.

6. The removable switching element according to claim 1, wherein the two windows each have dimensions adapted to a profile of a corresponding contact pad borne by the mobile electrical conductor.

7. An electrical switching device configured to switch an electric current, comprising:

a base including compartments that are delimited by separating walls;

a removable switching element according to claim 1, being configured to switch an electric current and to be accommodated in one of the compartments of the base, such that connection terminals of the removable switching element are electrically connected to electrical connections lands of the device.

8. The electrical switching device according to claim 7, wherein the separating walls are made of an electrically insulating material.

9. The electrical switching device according to claim 7, wherein the separating walls include ribs, and wherein lateral faces of the removable switching element are provided with protrusions, shapes of the protrusions being complementary to those of the ribs, so as to guide the removable switching element when inserted into said one of the compartments.

10. The removable switching element according to claim 1, wherein the two windows are each rectangular or elliptical in shape.

11. The removable switching element according to claim 1, wherein each window of the two windows is configured to allow a mechanical dissociation of the electrical contact between the first and second fixed electrical conductors at the first and second contact areas, respectively, when the mobile electrical conductor is disposed in the first position.

12. The electrical switching device according to claim 7, wherein each window of the two windows of the removable switching element is configured to allow a mechanical dissociation of the electrical contact between the first and second fixed electrical conductors at the first and second contact areas, respectively, when the mobile electrical conductor is disposed in the first position.

13. The removable switching element according to claim 1, wherein a state of contact between the mobile electrical conductor and the first and second fixed electrical conductors is viewable through each window of the two windows when the mobile electrical conductor is in the first position and when the mobile electrical conductor is in the second position.

14. The electrical switching device according to claim 7, wherein a state of contact between the mobile electrical conductor and the first and second fixed electrical conductors of the removable switching element is viewable through each window of the two windows when the mobile electrical conductor is in the first position and when the mobile electrical conductor is in the second position.

* * * * *